US005685536A

United States Patent [19]

Barthold

[11] Patent Number: 5,685,536

[45] Date of Patent: Nov. 11, 1997

[54] DEVICE FOR GUIDING AND HOLDING DOWN OF SHEETS ON A SHEET STACK

[75] Inventor: Ulrich Barthold, Baltmannsweiler-Hohengehren, Germany

[73] Assignee: Eastman Kodak Company, Rochester, N.Y.

[21] Appl. No.: 569,632

[22] Filed: Dec. 8, 1995

[30] Foreign Application Priority Data

Dec. 14, 1994 [DE] Germany ..... 44 44 488.5

[51] Int. Cl.[6] ..... B65H 31/26

[52] U.S. Cl. ..... 271/220; 211/51; 414/907

[58] Field of Search ..... 211/51; 271/20.7, 271/220; 414/907

[56] References Cited

U.S. PATENT DOCUMENTS

| | | | |
|---|---|---|---|
| 769,375 | 9/1904 | Cain | 211/51 |
| 3,892,309 | 7/1975 | Coffey et al. | 211/51 |
| 4,273,325 | 6/1981 | Rodewald | 271/220 |
| 4,890,825 | 1/1990 | McCormick et al. | 271/188 |
| 5,197,728 | 3/1993 | Radtke | 271/220 |
| 5,332,210 | 7/1994 | Silverberg et al. | 271/220 |

*Primary Examiner*—H. Grant Skaggs
*Attorney, Agent, or Firm*—Lawrence P. Kessler

[57] ABSTRACT

The subject is a device for guiding and holding down of sheets supplied singly by a conveyor device to a sheet stack formed in a storage container, said device comprising a two-armed lever pivotably mounted about a bearing point located above the sheet conveying track.

8 Claims, 2 Drawing Sheets

DEVICE FOR GUIDING AND HOLDING DOWN OF SHEETS ON A SHEET STACK

BACKGROUND OF THE INVENTION

The invention relates to a device for guiding and holding down of sheets supplied singly by a conveyor device to a sheet stack formed in a storage container, said device comprising a two-armed lever pivotably mounted about a bearing point located above the sheet conveying track.

A device of this type is known from, for example, U.S. Pat. No. 4,890,825. In a sheet stack and aligning unit, a two-armed lever is pivotably arranged behind a sheet conveying device; it rests with one of its arms on the sheet stack in order to stabilize the sheets in their aligned position and to prevent curling of the sheet ends, while its other arm carries a weight to balance out the lever. This device has the drawback that the contact force of the arm resting on the sheet stack also changes considerably as the sheet stack height changes. This leads to unacceptable operating conditions, since in current machines working with a sheet rate of up to 90 sheets per minute, a guiding and holding-down device of this type does not guarantee dependable functioning of the machine when forming the sheet stack.

SUMMARY OF THE INVENTION

The object underlying the present invention is therefore to create a device of the type mentioned at the outset whose contact force on the sheet stack is substantially constant regardless of the height of the stack. In addition, the mass moment of inertia of the device should be as low as possible in order to assure that the sheet rate minute is largely independent of the contact force of the holding-down arm.

This is attained in accordance with the invention in that the first arm is designed as the holding-down arm, is at an acute angle to the stack surface, and rests with its free end on the sheet stack; the second arm supports a weight; the two arms form with one another an angle $\gamma$ enclosing the bearing point, such that the line of application of the weight is above the bearing point and such that, depending on the distance l of the weight from the bearing point and on the angle $\gamma$, the center of gravity of the lever is on a line forming an optimized angle $\delta$ with the first arm.

In a device of this design, a uniform contact force is achieved for each sheet stack height by the center of gravity of the device being arranged on the line at the angle $\delta$. With an optimized angle $\delta$, the change in the contact force depends on the distance of the bearing point from the resting point of the holding-down arm. This shift of the center of gravity along the line running under the angle $\delta$ is achieved by a change in the distance of the weight from the bearing point on the lever arm arranged under the angle $\gamma$.

In detail, the invention is such that the weight is designed in the form of a cylinder that is longitudinally movable on the second arm. Selection of the cylindrical form for the weight means that its mass moment of inertia has only a linear dependence on its length, so that the mass moment of inertia of the device is kept very low and a very wide latitude is available for determining the value of a uniform contact force. This means too that with certain dimensions for the diameter of the weight, for the angle and for the distance of the weight from the bearing point, the contact force is settable to a uniform value within a wide range.

In a guiding and holding-down device of this type, a uniform contact force on the sheet stack is provided regardless of the position in which it is built in.

In a further embodiment of the device, the arms of the lever have a flat and rectangular cross-section, and the bearing point is provided in a simple manner in a wall arranged on one side between the arms.

In order to compensate for the single bearing of the lever and to avoid friction effects, the weight on the second arm is arranged with an offset in relation to the central position in the direction of the bearing point. The weight can also be arranged movably and fixably in the direction of the bearing point axis.

Further features and advantages are described in the description of an embodiment of the invention, and in the further sub-claims.

DESCRIPTION OF THE PREFERRED EMBODIMENT

Figure 1:
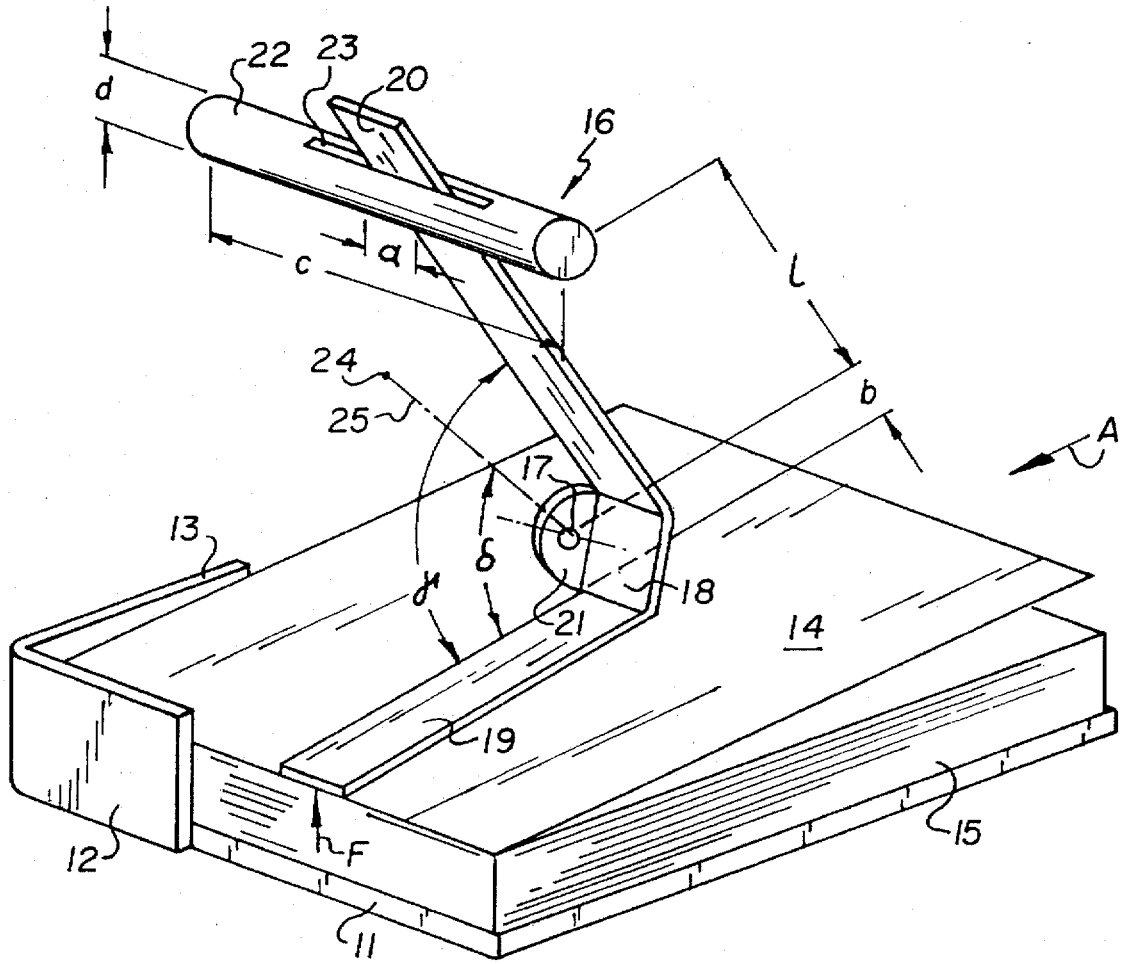
FIG. 1 shows the device in accordance with the invention in diagram form.

FIG. 1 shows the device in accordance with the invention, with all components not contributing to the invention having been omitted for reasons of clarity.

A sheet stack 15 is in a storage container 11 with a front wall 12 and a side wall 13 for precisely-edged positioning of sheets conveyed in the direction of the arrow A. In order to stabilize the incoming sheets 14 on the stack 15 after their movement, and to keep them in the precisely-edged position, a device 16 is provided that comprises a two-armed lever 18 pivotably mounted about a bearing point 17.

The lever 18 has a first arm 19 resting on the edge of the topmost sheet 14 which is up against the front wall 12 in order to stabilize the incoming sheets after their movement and to hold them down. The lever 18 has a second arm 20 bent at an angle $\delta$ enclosing the bearing point 17 in the same plane as the first arm 19.

The two arms 19 and 20 have a flat, rectangular cross-section and enclose at the same time a vertically angled wall 21 in which the bearing point 17 is provided at a distance b in relation to the first arm 19.

On the second arm 20, a weight 22 is arranged, with the arm 20 projecting through a slot 23 in the weight 22. The slot 23 is so dimensioned that the weight 22 can be moved and fixed on the arm 20 in the longitudinal and transverse directions.

The weight 22 comprises a cylindrical rod of a certain diameter d and a selectable length c, and is located at a certain and variable distance l from the bearing point 17.

Depending on the distance l and the angle $\gamma$, the result for the device 16 is a certain position of its center of gravity 24 on a line 25 running at an angle $\delta$ in relation to the first arm 19. The position of the center of gravity 24 on the line 25 can be influenced by altering the distance l of the weight 22 from the bearing point 17, since the line of application of the force from the weight 22 is above the bearing point 17.

With optimized dimensioning and assignment of the parameters distance l of the weight 22 from the bearing point 17, angle $\gamma$, and diameter d of weight 22, a certain angle $\delta$ is obtained and hence a defined position of the center of gravity 24, leading to a uniform contact force F of the first arm 19 over the entire sheet stack height from the first to the last sheet. The usual maximum stack height here is about 20 to 25 mm.

Figure 2:
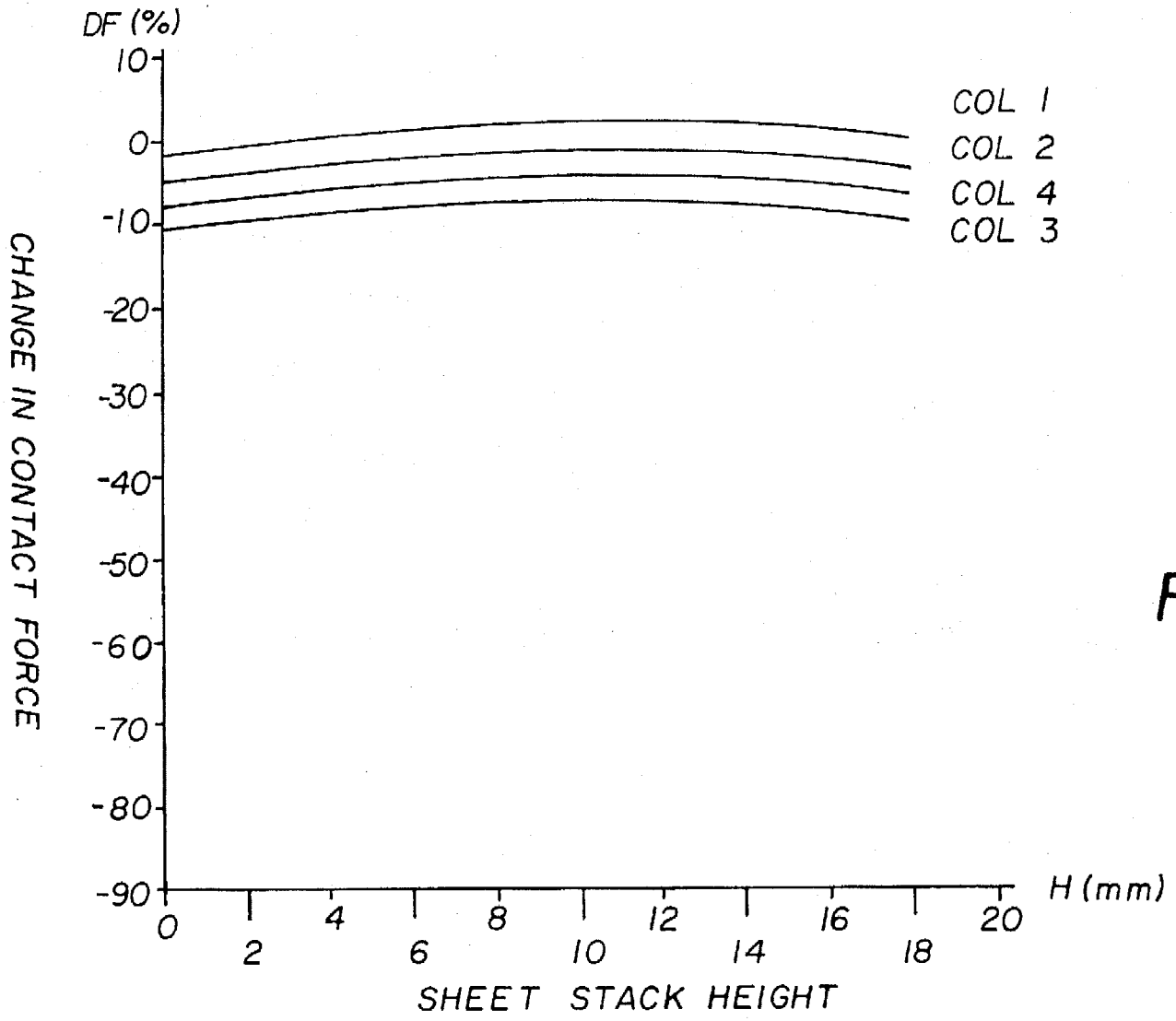
FIG. 2 shows a graph of the change in the contact force of the device on the sheet stack in relation to the height of the sheet stack.

On the basis of a finite-element calculation, the uniformity of the contact force is made impressively clear in the graph in FIG. 2 for a possibly optimized version of the device with a storage container 11 inclined at an angle of 50 degrees. The following values are obtained:

the angle γ between the first arm 19 and the second arm 20 is about 122 angular degrees, the angle δ between the first arm 19 and the line 25 of the center of gravity 24 is approx. 98 angular degrees, the distance l between the bearing point 17 and the weight 22 is about 20 millimeters, the distance b between the bearing point 17 and the first arm 19 is about 13.5 millimeters, and the diameter d and the length c of the weight 22 are about 8 millimeters and 30 millimeters respectively.

In the very simply designed lever 18, the bearing point 17 is arranged laterally to the lever center. To achieve a low beating friction, the weight 22 can be moved on the arm 20 in the direction of the wall 21 by the dimension a as a function of the dimension of the lever. This balances out the lever 18 in its center position. The length of the slot 23 is dimensioned accordingly.

The device 11 can be used for storage containers arranged both horizontally and at an angle.

I claim:

1. Device for guiding and holding down of sheets supplied singly by a conveyor device along a conveying track to a sheet stack (15) formed in a storage container (11) having a front wall (12), said device comprising:

a two-armed lever (18) pivotably mounted about a bearing point (17) located above said sheet conveying track, said two-armed lever (18) including a first arm (19) serving as a sheet holding-down arm, at an acute angle to the surface of said sheet stack (15), resting with its free end on said sheet stack (15), and a second arm (20) adjustably supporting a weight (22), said first and second arms (19 and 20) forming with one another an angle (γ) enclosing said bearing point (17) such that the line of application of force of said weight (22) is above said beating point (17) and such that, depending on the distance (1) of said weight (22) from said bearing point (17) and on said angle (δ), the center of gravity (24) of said lever (18) is on a line (25) forming an angle (δ) with said first arm (19) to provide a predetermined hold-down force.

2. Device according to claim 1, characterized in that said weight (22) has the form of a cylinder.

3. Device according to claim 1, characterized in that said weight (22) is arranged longitudinally movable on said second arm (20).

4. Device according to claim 1, characterized in that said weight is adjustable transversely movable on said second arm (20).

5. Device according to claim 1, characterized in that said first and second arms (19 and 20) of said lever (18) have a flat, rectangular cross-section, and in that a wall (21) is provided on one side between said arms, and said bearing point (17) is located in said wall.

6. Device according to claim 5, characterized in that said weight (22) on the second arm (20) is offset in relation to a central position in the direction of said bearing point (17).

7. Device according to claim 6, characterized in that said storage container (11) is at an angle of 50 degrees, said angle (γ) between said first arm and said second arm (19, 20) is about 122 degrees, said angle (δ) between said first arm (19) and said line (25) of said center of gravity (24) is about 98 degrees, said distance (1) between said bearing point (17) and said weight (22) is about 20 millimeters, the distance (b) between said bearing point (17) and said first arm (19) is about 13.5 millimeters, and said weight is a cylinder having a diameter (d) and length (c) of about 8 millimeters respectively.

8. Device according to claim 1, characterized in that the length of said first arm (19) is selected so that said first arm rests in the area of said sheet stack (15) where the front edge is in contact with said front wall (12) of the container (11).

* * * * *